US007361048B2

(12) United States Patent
Shimada

(10) Patent No.: US 7,361,048 B2
(45) Date of Patent: Apr. 22, 2008

(54) ELECTRICAL CONNECTOR

(75) Inventor: Yoshinobu Shimada, Machida (JP)

(73) Assignee: I-Pex Co., Ltd., Tokyo (JP)

( * ) Notice: Subject to any disclaimer, the term of this patent is extended or adjusted under 35 U.S.C. 154(b) by 0 days.

(21) Appl. No.: 11/492,813

(22) Filed: Jul. 26, 2006

(65) Prior Publication Data

US 2007/0076400 A1 Apr. 5, 2007

(30) Foreign Application Priority Data

Aug. 31, 2005 (JP) ..... 2005-250462

(51) Int. Cl.
*H01R 12/24* (2006.01)

(52) U.S. Cl. ..... 439/492

(58) Field of Classification Search ..... 439/492, 439/260, 67, 79, 357, 267, 493–499, 358, 439/329

See application file for complete search history.

(56) References Cited

U.S. PATENT DOCUMENTS 6,726,497 B2 * 4/2004 Nogawa et al. ..... 439/260
7,044,773 B2 * 5/2006 Suzuki et al. ..... 439/495
7,083,454 B2 * 8/2006 Suzuki ..... 439/260

FOREIGN PATENT DOCUMENTS

JP 2002-270290 9/2002

* cited by examiner

*Primary Examiner*—Edwin A. Leon
(74) *Attorney, Agent, or Firm*—Donald R. Studebaker; Nixon Peabody LLP

(57) ABSTRACT

An electrical connector comprises a housing made of insulator and attached to a main circuit board, conductive contacts arranged in the housing, and an actuator provided to be rotatable to the housing for engaging with the conductive contacts and to take up first and second stations selectively for bringing each of the conductive contacts into press-contact with a corresponding one of connecting terminals on a circuit board member inserted into the housing in the second station and for causing each of the conductive contacts to get out of press-contact with the corresponding one of the connecting terminals in the first station, wherein the actuator is provided with a covering portion for concealing an end portion of each of the conductive contacts connected electrically with one of conductive circuit pattern portions provided on the main circuit board when the actuator is in the second station.

9 Claims, 8 Drawing Sheets

ELECTRICAL CONNECTOR

BACKGROUND OF THE INVENTION

1. Field of the Invention

The present invention relates generally to an electrical connector, and more particularly to an improvement in an electrical connector used for putting connecting terminals provided on a circuit board, such as a flexible printed circuit board (FPC), conductors provided in a flexible flat cable assembly (FFC) or the like in electrical connection with conductive circuit pattern portions formed on a main circuit board.

2. Description of the Prior Art

In the field of electronic apparatus including a mobile telephone, a portable telephone with a camera and so on, a relatively small-sized flexible printed circuit board is often mounted on a main printed circuit board, on which various electrical parts are directly mounted, by means of an electrical connector which is fixed to and connected electrically with the main printed circuit board. The electrical connector has a plurality of conductive contacts for coming into contact with connecting terminals provided on the flexible printed circuit board and is operative to connect, through the conductive contacts, the connecting terminals provided with the flexible printed circuit board with conductive circuit pattern portions formed in print on the main printed circuit board.

For example, a previously proposed electrical connector, which is used for mounting a flexible printed circuit board on a main printed circuit board, is provided with a housing made of insulator which has an opening through which the flexible printed circuit board is partially inserted into the housing. In the housing, a plurality of conductive contacts are arranged along the opening. These conductive contacts are operative to come into contact with a plurality of connecting terminals provided on the flexible printed circuit board when the flexible printed circuit board is partially inserted into the housing through the opening. The electrical connector is further provided with an actuator which is attached rotatably to the housing to be common to the conductive contacts arranged in the housing. When the actuator is rotated in regard to the housing, each of the conductive contacts is partially moved in the housing.

Each of the conductive contacts arranged in the housing is made of conductive resilient material to have a fixed portion which is fixed to the housing and a movable portion coupled with the fixed portion. The fixed portion of the conductive contact is connected electrically with a conductive circuit pattern portion provided on the main printed circuit board. The movable portion of the conductive contact constitutes an operating part which is moved by the actuator.

In the previously proposed electrical connector as mentioned above, when the flexible printed circuit board is partially inserted into the housing through the opening provided thereon and the actuator is rotated in a predetermined direction, the actuator operates to move the movable portion of each of the conductive contacts to come into press-contact with a corresponding one of the connecting terminals provided on the flexible printed circuit board, as shown in, for example, the Japanese patent application published before examination under publication number 2002-270290 (A publication document). Then, when the actuator by which the operating part of each of the conductive contacts is brought into press-contact with the corresponding connecting terminal provided on the flexible printed circuit board is rotated in a direction opposite to the predetermined direction, the movable portion of each of the conductive contacts is allowed by the actuator to move for getting out of press-contact with the corresponding connecting terminal provided on the flexible printed circuit board.

In such an electrical connector as shown in the published document, as shown in FIG. 1, a plurality of conductive contacts 13 are arranged on a housing 12 made of insulating material and attached to a main printed circuit board 11 and an actuator 14 is provided also on the housing 12 to be rotateble to the same. When the electrical connector thus constituted is put in its function, first, the actuator 14 is postured to take up a first station in which the actuator 14 keeps rising from the housing 12, as shown in FIG. 1. Then, a flexible printed circuit board 15 is partially inserted into the housing 12 through an opening provided on the housing 12 and the actuator 14 is rotated to shift from the first station to a second station in which the actuator 14 keeps lying down on the housing 12, as shown in FIG. 2. Thereby, a movable portion serving as an operating part of each of the conductive contacts 13 is moved by the actuator 14 to come into press-contact with a corresponding one of a plurality of connecting terminals 20 provided on the flexible printed circuit board 15.

Each of the conductive contacts 13 is made of conductive resilient material and formed into an H-shaped member, as shown in FIG. 3. The conductive contact 13 has a pair of beams 17 and 18 coupled with each other through a connecting portion 16. The beam 17 constitutes a fixed portion of the conductive contact 13 and the beam 18 constitutes the movable portion of the conductive contact 13. An end portion 17*a* of the beam 17 is electrically connected with a conductive circuit pattern portion 19 provided on the main printed circuit board 11.

The actuator 14 has a plurality of engaging portions 21 operative to engage with the conductive contacts 13, respectively, as shown in FIG. 3.

When the flexible printed circuit board 15 is partially inserted into the housing 12 through the opening provided thereon, a part of the flexible printed circuit board 15 on which the connecting terminals 20 are provided is placed between the beam 17 and the beam 18 of each of the conductive contacts 13. The engaging portion 21 of the actuator 14 which is in the second station to keep lying down on the housing 12 engages with the conductive contact 13 for moving the beam 18 of the conductive contact 13 so as to cause an end portion 18*a* of the beam 18 to come into press-contact with the corresponding connecting terminal 20 provided on the part of the flexible printed circuit board 15, as shown in FIG. 3. Thereby, the part of the flexible printed circuit board 15 on which the connecting terminal 20 are provided and inserted into the housing 12 is held by the beams 17 and 18 of each of the conductive contacts 13.

When the actuator 14 is in the second station to keep lying down on the housing 12, as shown in FIGS. 2 and 3, a vacant space 22 is formed between a portion of the main printed circuit board 11 adjacent to the conductive circuit pattern portions 19, with which the end portions 17*a* of the beams 17 are electrically connected, respectively, and a part of the actuator 14 facing the same portion of the main printed circuit board 11. This vacant space 22 allows dust or mote to pass through the vacant space 22 and to stick to the conductive circuit pattern portion 19 and the end portion 17*a* of the beam 17 connected electrically with the conductive circuit pattern portion 19. Therefore, it is seriously feared that such sticking of dust or mote as mentioned above brings about disadvantages or problems of defective conduction between the end portion 17*a* of the beam 17 and the conductive circuit pattern portion 19, an undesirable short circuit between the end portions 17*a* of the beams 17, an undesirable short circuit between the conductive circuit pattern portions 19 and so on.

Accordingly, it has been previously proposed to apply an adhesive agent which sets after applied on the main printed circuit board 11 to form a wall 23 of stiffened adhesive agent, as shown in FIG. 3. The wall 23 of stiffened adhesive agent blocks up the vacant space 22 between the portion of the main printed circuit board 11 adjacent to the conductive circuit pattern portions 19 and the part of the actuator 14 facing the same portion of the main printed circuit board 11.

In the case of the electrical connector thus proposed previously to be used for mounting the flexible printed circuit board on the main printed circuit board, in which when the flexible printed circuit board is partially inserted into the housing through the opening provided thereon and the actuator is postured to keep lying down on the housing for causing the movable portion of each of the conductive contacts to come into press-contact with the corresponding connecting terminal provided on the flexible printed circuit board, the vacant space formed between the portion of the main printed circuit board adjacent to the conductive circuit pattern portions, with which the conductive contacts are electrically connected, respectively, and the part of the actuator facing the same portion of the main printed circuit board, is blocked up by the wall of stiffened adhesive agent, disadvantages accompanied with formation of the wall of stiffened adhesive agent are brought about. That is, the disadvantages that the amount of work for mounting the flexible printed circuit board on the main printed circuit board is increased by applying the adhesive agent on the main printed circuit board, it is additionally required to control the adhesive agent applied on the main printed circuit board in its quantity, and it is not easy to form appropriately the wall of stiffened adhesive agent functioning effectively, are accompanied with the formation of the wall of stiffened adhesive agent.

OBJECTS AND SUMMARY OF THE INVENTION

Accordingly, it is an object of the present invention to provide an electrical connector comprising a housing made of insulator and attached to a main circuit board, a plurality of conductive contacts provided in the housing, each of which is electrically connected with a conductive circuit pattern portion provided on the main circuit board, and an actuator provided to be rotateble to the housing, wherein when a circuit board member is partially inserted into the housing and the actuator is rotated to take up a predetermined station, each of the conductive contacts is caused by the actuator to come into press-contact with a corresponding one of a plurality of connecting terminals provided on the circuit board member, and which avoids the aforementioned disadvantages encountered with the prior art.

Another object of the present invention is to provide an electrical connector comprising a housing made of insulator and attached to a main circuit board, a plurality of conductive contacts provided in the housing, each of which is electrically connected with a conductive circuit pattern portion provided on the main circuit board, and an actuator provided to be rotateble to the housing, wherein when a circuit board member is partially inserted into the housing and the actuator is rotated to take up a predetermined station, each of the conductive contacts is caused by the actuator to come into press-contact with a corresponding one of a plurality of connecting terminals provided on the circuit board member, and in which a vacant space between a portion of the main circuit board adjacent to the conductive circuit pattern portion provided on the main circuit board and the actuator taking up the predetermined station to facing the same portion of the main circuit board can be surely blocked up with a relatively simple structure.

A further object of the present invention is to provide an electrical connector comprising a housing made of insulator and attached to a main circuit board, a plurality of conductive contacts provided in the housing, each of which is electrically connected with a conductive circuit pattern portion provided on the main circuit board, and an actuator provided to be rotateble to the housing, wherein when a circuit board member is partially inserted into the housing and the actuator is rotated to take up a predetermined station, each of the conductive contacts is caused by the actuator to come into press-contact with a corresponding one of a plurality of connecting terminals provided on the circuit board member, and in which a vacant space between a portion of the main circuit board adjacent to the conductive circuit pattern portion provided on the main circuit board and the actuator taking up the predetermined station to facing the same portion of the main circuit board can be easily blocked up without increasing the amount of work for mounting the circuit board member on the main circuit board.

A still further object of the present invention is to provide an electrical connector comprising a housing made of insulator and attached to a main circuit board, a plurality of conductive contacts provided in the housing, each of which is electrically connected with a conductive circuit pattern portion provided on the main circuit board, and an actuator provided to be rotateble to the housing, wherein when a circuit board member is partially inserted into the housing and the actuator is rotated to take up a predetermined station, each of the conductive contacts is caused by the actuator to come into press-contact with a corresponding one of a plurality of connecting terminals provided on the circuit board member, and in which a vacant space between a portion of the main circuit board adjacent to the conductive circuit pattern portion provided on the main circuit board and the actuator taking up the predetermined station to facing the same portion of the main circuit board can be surely blocked up without using a wall of stiffened adhesive agent formed in the vacant space.

According to the present invention, as claimed in any one of claims, there is provided an electrical connector, which comprises a housing made of insulator and attached to a main circuit board, a plurality of conductive contacts arranged in the housing, each of which is positioned to correspond to one of a plurality of connecting terminals provided on a circuit board member when the circuit board member is partially inserted into the housing, and an actuator provided to be rotatable to the housing for engaging with the conductive contacts and to take up first and second stations selectively for bringing each of the conductive contacts into press-contact with one of the connecting terminals corresponding thereto when the circuit board member is partially inserted into the housing and the actuator is shifted from the first station to the second station and for causing each of the conductive contacts to get out of press-contact with the corresponding one of the connecting terminals when the circuit board member partially inserted into the housing and the actuator is shifted from the second station to the first station, wherein the actuator is provided with a covering portion for concealing an end portion of each of the conductive contacts connected electrically with one of conductive circuit pattern portions provided on the main circuit board when the actuator is postured to take up the second station.

Especially, in one embodiment of electrical connector according to the present invention, the covering portion is operative to come close to or come into contact with the main circuit board at a position out of the conductive circuit pattern portions on the main circuit board so that the end portion of each of the conductive contacts connected electrically with the conductive circuit pattern portion is concealed at the inner side of the covering portion.

Further, in another embodiment of electrical connector according to the present invention, the actuator has a plurality of cams each engaging with a movable portion of each of the conductive contacts and operative to move the movable portion to come into press-contact with the connecting terminal provided on the circuit board member which is partially inserted into the housing, and each of the cams is supported to be rotatable by an engaging portion formed on each of the conductive contacts.

In the electrical connector thus constituted in accordance with the present invention, when the circuit board member, such as a flexible printed circuit board, is partially inserted into the housing and the actuator is rotated to shift from the first station to the second station, the actuator in the movement from the first station to the second station operates to bring each of the conductive contacts arranged in the housing into press-contact with one of the connecting terminals provided on the circuit board member corresponding thereto. After that, when the actuator is rotated to shift from the second station to the first station, the actuator in the movement from the second station to the first station operates to cause each of the conductive contacts to get out of press-contact with the corresponding one of the connecting terminals.

In such operations, the actuator shifted from the first station to the second station conceals the end portion of each of the conductive contacts connected electrically with the conductive circuit pattern portion provided on the main circuit board with the covering portion in the second station. The covering portion provided on the actuator is operative, for example, to come close to or come into contact with the main circuit board at the position out of the conductive circuit pattern portion on the circuit board so that the end portion of each of the conductive contacts connected electrically with the conductive circuit pattern portion is concealed at the inner side of the covering portion.

Further, the actuator may be provided with the cams each engaging with the movable portion of each of the conductive contacts and operative to move the movable portion to come into press-contact with the connecting terminal provided on the circuit board member which is partially inserted into the housing. In that case, the actuator is rotated to shift from the first station to the second station and from the second station to the first station with the cams each supported to be rotatable by the engaging portion formed on each of the conductive contacts.

With the electrical connector in accordance with the present invention, when the actuator is postured to take up the second station so as to bring each of the conductive contacts into press-contact with the corresponding one of the connecting terminals provided on the circuit board member which is partially inserted into the housing, the covering portion provided on the actuator is operative to conceal at the inner side thereof the end portion of each of the conductive contacts connected electrically with the conductive circuit pattern portion provided on the main circuit board, for example, by coming close to or coming into contact with the main circuit board at the position out of the conductive circuit pattern portion provided on the main circuit board, and thereby a vacant space between a portion of the main circuit board adjacent to the conductive circuit pattern portion provided on the main circuit board and the actuator taking up the second station to facing the same portion of the main circuit board is blocked up with the covering portion provided on the actuator.

Accordingly, when the actuator is postured to take up the second station so as to bring each of the conductive contacts into press-contact with the corresponding one of the connecting terminals provided on the circuit board member which is partially inserted into the housing, the vacant space between the portion of the main circuit board adjacent to the conductive circuit pattern portion provided on the main circuit board and the actuator taking up the second station to facing the same portion of the main circuit board can be surely and easily blocked up with a relatively simple structure and without increasing the amount of work for mounting the circuit board member on the main circuit board. As a result, dust or mote is prevented from passing through the vacant space so as to stick to the conductive circuit pattern portion on the main circuit board and an end portion of each of the conductive contacts connected electrically with the conductive circuit pattern portion, and therefore disadvantages or problems of defective conduction between the end portion of each of the conductive contacts and the conductive circuit pattern portion, an undesirable short circuit between the end portions of the conductive contacts, an undesirable short circuit between the conductive circuit pattern portions and so on can be effectively avoided.

Further, with the embodiment of electrical connector in accordance with the present invention, since each of the cams engaging with the movable portion of each of the conductive contacts and operative to move the movable portion to come into press-contact with the connecting terminal provided on the circuit board member which is partially inserted into the housing, is supported to be rotatable by the engaging portion formed on each of the conductive contacts, it is not required, for example, to provide on the housing a rotary axis and bearings for rotating the cams and thereby the whole construction of the electrical connector can be simplified. In addition, since the actuator provided thereon with the cams is supported to be rotatable at predetermined intervals by the engaging portions formed respectively on the conductive contacts, the actuator and the housing are prevented from arising mechanical distortions and thereby the conductive contacts arranged in the housing are able to keep appropriate and uniform press-contact with the connecting terminals provided on the circuit board member.

The above, and other objects, features and advantages of the present invention will become apparent from the following detailed description taken in conjunction with the accompanying drawings.

DESCRIPTION OF THE PREFERRED EMBODIMENTS

FIGS. 4 to 9 show a first embodiment of electrical connector according to the present invention, together with a circuit board on which the first embodiment is fixed and a circuit board member partially inserted into the first embodiment.

Figure 1:
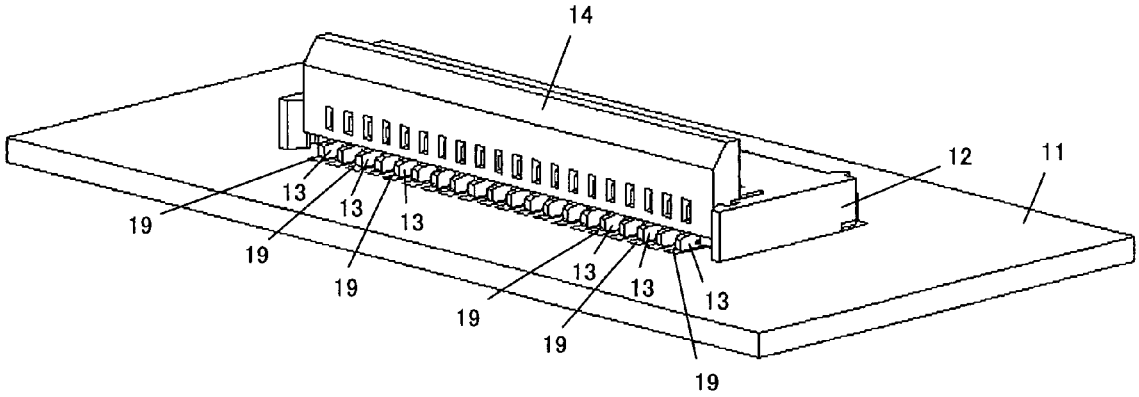
FIGS. 1 and 2 are schematic perspective views each showing an example of previously proposed electrical connector, together with a circuit board on which the example is fixed.
Figure 2:
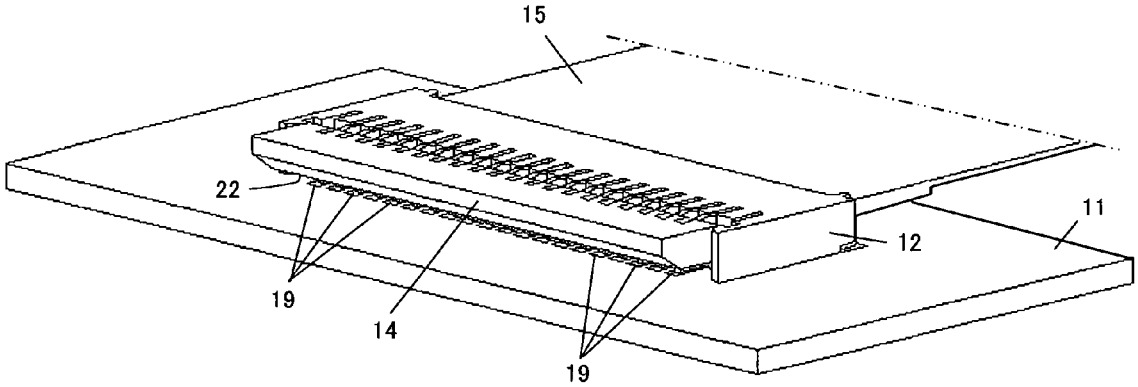
Figure 3:
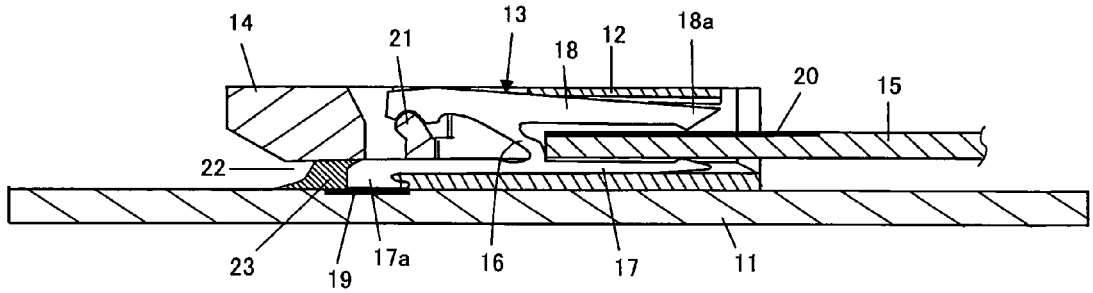
FIG. 3 is a schematic cross sectional view used for explaining the structure and operation of the example shown in FIGS. 1 and 2.
Figure 4:
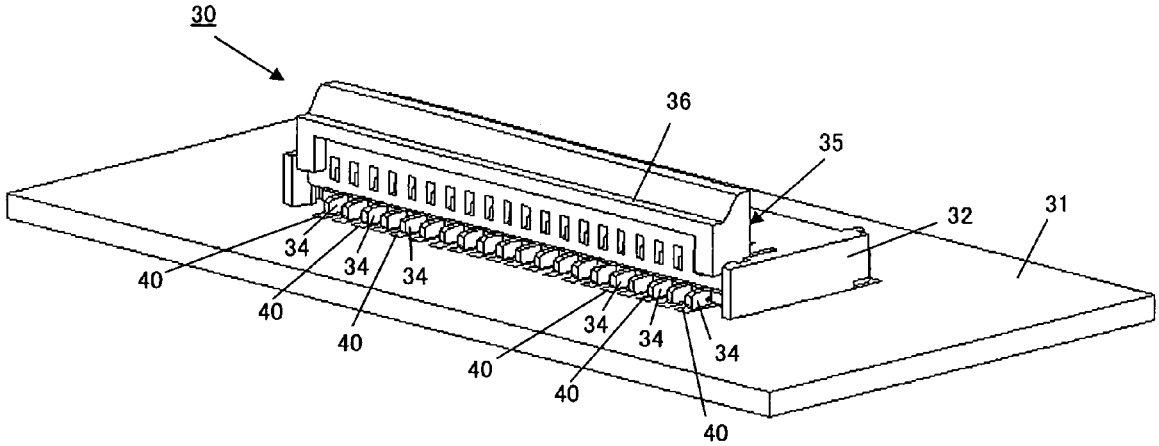
FIGS. 4, 5, 7 and 8 are schematic perspective views each showing a first embodiment of electrical connector according to the present invention, together with a circuit board on which the first embodiment is fixed.
Figure 5:
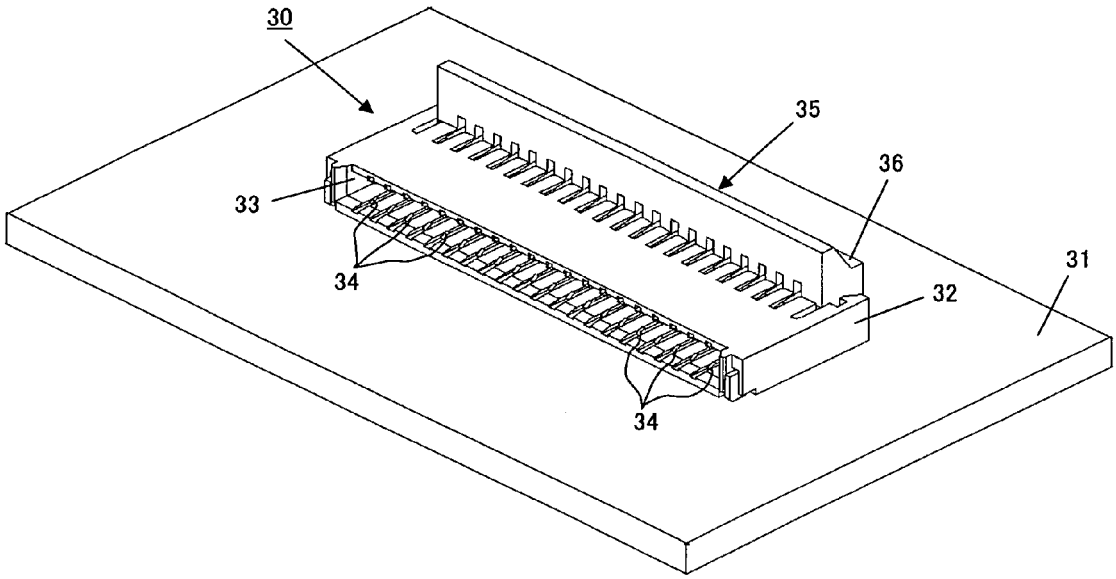
Figure 6:
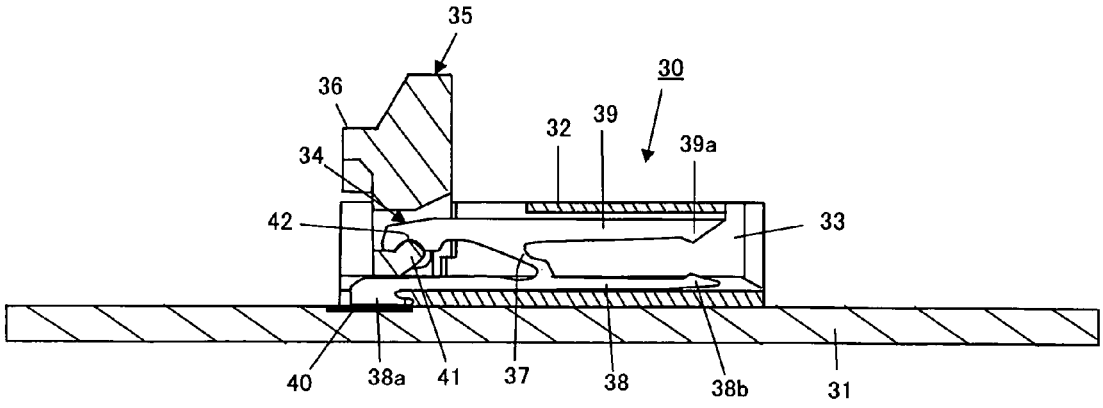
FIGS. 6 and 9 are schematic cross sectional views used for explaining the structure and operation of the first embodiment shown in FIGS. 4, 5, 7 and 8.
Figure 7:
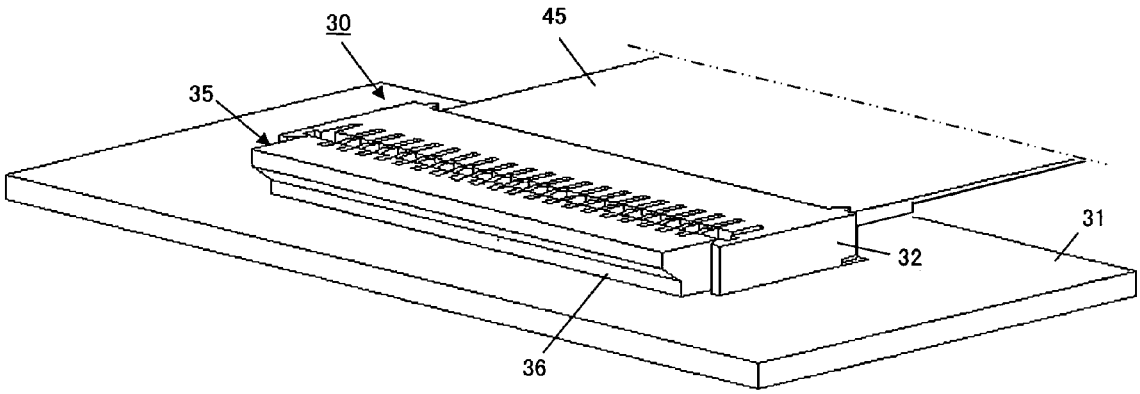
Figure 8:
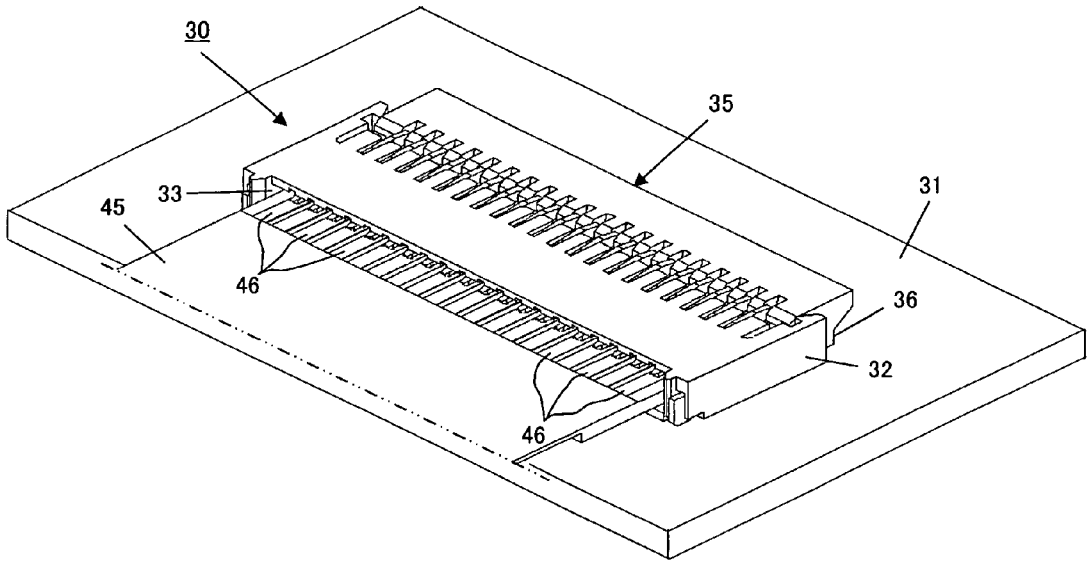
Figure 9:
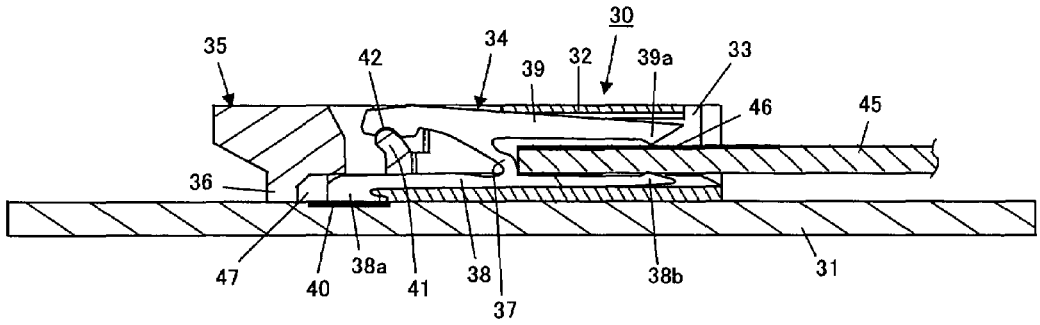

Referring to FIGS. 4 to 6, an electrical connector 30, which constitutes the first embodiment of electrical connector according to the present invention, has a housing 32 made of insulator such as plastics or the like and attached to a main circuit board 31. The housing 32 is provided with an opening 33 through which a circuit board member is partially inserted into the housing 32. With the housing 32 thus attached to the main circuit board 31 with the opening 33, the electrical connector 30 in its entirety is fixed on the main circuit board 31. Then, for example, a flexible printed circuit board 45, which will be explained later with reference to FIGS. 7 to 9, is partially inserted into the housing 32 through the opening 33.

A plurality of conductive contacts 34 are arranged in the housing 32 of the electrical connector 30. Further, an actuator 35 elongating along the arrangement of the conductive contacts 34 is provided to be rotatable to the housing 32 and positioned at a side of the housing 32 opposite to another side of the housing 32 at which the opening 33 is provided. The actuator 35 is provided with a covering portion 36 which constitutes a partition wall elongating in the shape of ], as shown in FIG. 4.

Then, the actuator 35 is postured to take up first and second stations selectively. In the first station, the actuator 35 keeps rising from the housing 32, as shown in FIGS. 4 to 6, and in the second station, the actuator 35 keeps lying down on the housing 32, as shown in FIGS. 7 to 9. The actuator 35 is rotated, as occasion demands, to shift from the first station to the second station or from the second station to the first station.

Each of the conductive contacts 34 arranged in the housing 32 is made of conductive resilient material and formed into an H-shaped plate member, as shown in FIG. 6. The conductive contact 34 has a pair of beams 38 and 39 coupled with each other through a connecting portion 37 to form the H-shaped plate member. The beam 38 constitutes a fixed portion of the conductive contact 34 and the beam 39 constitutes a movable portion of the conductive contact 34 serving as an operating part of the conductive contact 34. An end portion 38*a* of the beam 38 is electrically connected with one of conductive circuit pattern portions 40 provided on the main circuit board 31 on which the electrical connector 30 is mounted.

The actuator 35 has a plurality of cams 41 each engaging with one of the conductive contacts 34, as shown in FIG. 6. In detail, the cam 41 is operative to engage with an engaging portion 42 formed on the beam 39 constituting the movable portion of the conductive contact 34.

Each of the cams 41 is put between the beams 38 and 39 of the corresponding one of the conductive contacts 34 to be in contact with both of the beams 38 and 39 and rotates with the actuator 35. The engaging portion 42 formed on the beam 39 of each of the conductive contacts 34 is operative to support the cam 41 corresponding thereto to be rotatable.

When the actuator 35 is postured to take up the first station, as shown in FIGS. 4 to 6, each of the cams 41 engages with the engaging portion 42 formed on the beam 39 of the conductive contact 34 at a relatively low position in a relatively small distance from the main circuit board 31, as shown in FIG. 6. Thereby, the cam 41 causes the beam 39 to be so positioned that a relatively large space is formed between an end portion 38*b* of the beam 38 and the end portion 39*a* of the beam 39 on the side of the housing 32 at which the opening 33 is provided and the end portion 39*a* of the beam 39.

Under such a situation, when a flexible printed circuit board 45 is partially inserted into the housing 32 through the opening 33 and the actuator 35 is rotated to shift from the first station to the second station, as shown in FIGS. 7 and 8, each of the conductive contacts 34 is brought into press-contact with one of a plurality of connecting terminals 46 provided on a part of the flexible printed circuit board 45 inserted partially into the housing 32.

In this operation, first the flexible printed circuit board 45 is partially inserted into the housing 32 through the opening 33 when the actuator 35 is in the first station and the part of the flexible printed circuit board 45 on which the connecting terminals 46 are provided is placed between the beam 38 and the beam 39 of each of the conductive contacts 34 in the housing 32. Next, the actuator 35 is rotated to move from the first station to the second station. With the movement of the actuator 35 from the first station to the second station, each of the cams 41 engages with the engaging portion 42 formed on the beam 39 of the conductive contact 34 at a relatively high position in a relatively large distance from the main circuit board 31, as shown in FIG. 9.

The cam 41 engaging with the engaging portion 42 formed on the beam 39 at the relatively high position operates to move the beam 39 so as to narrow the space between the end portion 38*b* of the beam 38 and the end portion 39*a* of the beam 39 on the side of the housing 32 at which the opening 33 is provided and then to cause the end portion 39*a* to come into press-contact with the connecting terminal 46 provided on the part of the flexible printed circuit board 45 inserted partially into the housing 32. Thereby, each of the connecting terminals 46 provided on the part of the flexible printed circuit board 45 inserted partially into the housing 32 is electrically connected through the conductive contact 34 with a corresponding one of the conductive circuit pattern portions 40 provided on the main circuit board 31.

Further, when the actuator 35 is postured to take up the second station, as shown in FIGS. 7 to 9, the covering portion 36 provided on the actuator 35 for constituting the partition wall operates to dispose its end surface in the shape of ] to come close to or come into contact with the main circuit board 31 at a position out of the conductive circuit pattern portions 40 so that the end portion 38*a* of the beam 38 of each of the conductive contacts 34 and each of the conductive circuit pattern portion 40 provided on the main circuit board 31, with which the end portion 38*a* of the beam 38 is electrically connected, are covered and concealed with the covering portion 36.

With the covering portion 36 thus covering and concealing the end portions 38*a* of the beams 38 and the conductive circuit pattern portions 40 provided on the main circuit board 31, a vacant space 47 formed between a portion of the main circuit board 31 adjacent to the conductive circuit pattern portions 40 provided on the main circuit board 31 and the actuator 35 taking up the second station is surely blocked up.

As a result, dust or mote is prevented from passing through the vacant space 47 so as to stick to the conductive circuit pattern portions 40 provided on the main circuit board 31 and the end portions 38*a* of the beams 38 of the conductive contacts 34 electrically connected respectively with the conductive circuit pattern portions 40, and therefore disadvantages or problems of defective conduction between the end portion 38*a* of each of the beam 38 and the conductive circuit pattern portion 40, an undesirable short circuit between the end portions 38*a* of the beams 38, an undesirable short circuit between the conductive circuit pattern portions 40 and so on can be effectively avoided.

The actuator 35 postured to take up the second station, as shown in FIGS. 7 to 9, is rotated to move from the second station to the first station, as occasion demands. The rotation of the actuator 35 for moving from the second station to the first station is opposite in direction to that for moving from the first station to the second station.

The actuator 35 in the rotation for moving from the second station to the first station operates to cause each of the conductive contacts 34 to get out of press-contact with the connecting terminals 46 provided on the part of the flexible printed circuit board 45. In this operation, with the rotation of the actuator 35 from the second station to the first station, each of the cams 41 provided on the actuator 35, which engages with the engaging portion 42 formed on the beam 39 of the conductive contact 34 to bring the end portion 39*a* of the beam 39 into press-contact with the connecting terminal 46 provided on the part of the flexible printed circuit board 45, operates to move the beam 39 so as to enlarge the space between the end portion 38*b* of the beam 38 and the end portion 39*a* of the beam 39 and then to cause the end portion 39*a* to get out of press-contact with the connecting terminals 46. Further, the movement of the actuator 35 from the second station to the first station, each of the cams 41 engages with the engaging portion 42 formed on the beam 39 of the conductive contact 34 at the relatively low position in the relatively small distance from the main circuit board 31.

Although the covering portion 36 provided on the actuator 35 to constitute the partition wall elongating in the shape of ] in the electrical connector 30 described above, it should be understood that the covering portion provided on the actuator of the electrical connector according to the present invention is not limited to such an example and provided in various shapes and dimensions for covering the end portions of the conductive contacts and the conductive circuit pattern portions provided on the main circuit board when the actuator is in the second station to keep lying down on the housing of the electrical connector.

Figure 10:
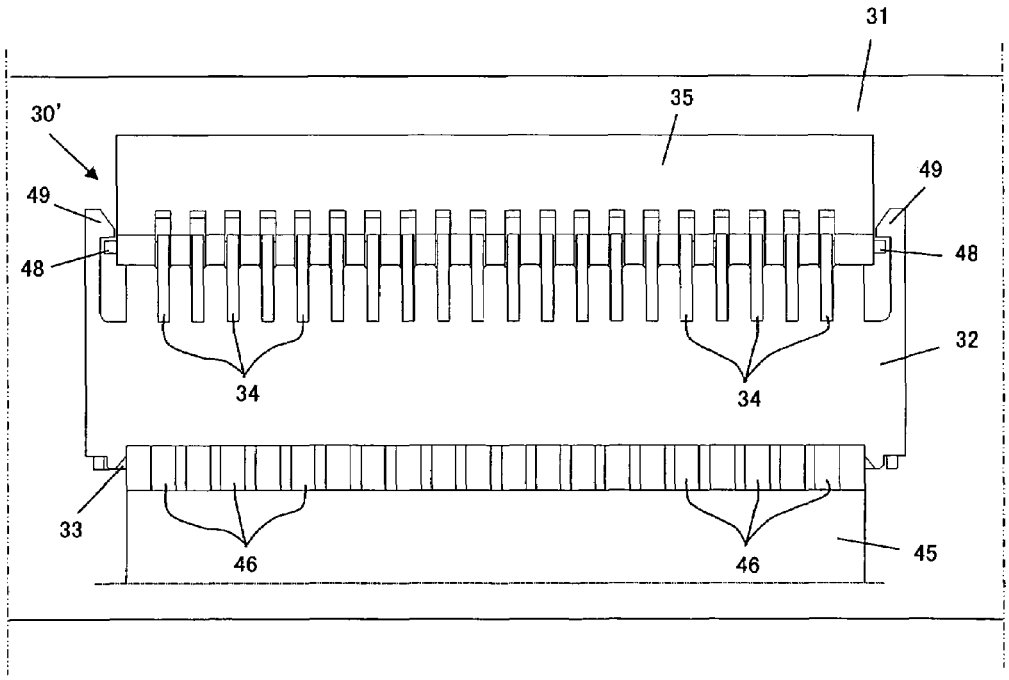
FIG. 10 is a schematic plane views each showing a second embodiment of electrical connector according to the present invention, together with a circuit board on which the second embodiment is fixed and a flexible printed circuit board partially inserted into the second embodiment.

FIG. 10 shows a second embodiment of electrical connector according to the present invention, together with a circuit board on which the second embodiment is fixed and a circuit board member partially inserted into the second embodiment.

Referring to FIG. 10, an electrical connector 30', which constitutes the second embodiment of electrical connector according to the present invention, has various parts and portions corresponding to those in the electrical connector 30 constituting the first embodiment shown in FIGS. 4 to 9, which are marked with the same references, and further description thereof will be omitted.

In the electrical connector 30' shown in FIG. 10, a part of a flexible printed circuit board 45 on which the connecting terminal 46 are arranged is inserted into a housing 32 of the electrical connector 30' through an opening 33 provided thereon and an actuator 35 which is provided with a covering portion 36 (not shown in FIG. 10) is in a second station corresponding to the second station in the first embodiment to keep laying down on the housing 32.

The actuator 35 is also provided with engaging projections 48 at both its end portions in a direction along the arrangement of a plurality on conductive contacts 34, in addition to the covering portion 36. Further, the housing 32 is provided with stoppers 49 at both its end portions of the housing 32 in the direction along the arrangement of the conductive contacts 34. The stoppers 49 are positioned to correspond to the engaging projections 48, respectively. The engaging projections 48 are operative to engage with the stoppers 49 for preventing the actuator 35 from coming off from the housing 32 in cooperation with the stoppers 49 when a plurality of cams 41 provided on the actuator 35 disengages from engaging portions 42 each formed on a beam 39 of each of the conductive contacts 34. The position and the shape of each of the engaging projection 48 and the stopper 49 shown in FIG. 10 are just examples and each of the engaging projection 48 and the stopper 49 may be provided in various positions and shapes for preventing effectively the actuator 35 from coming off from the housing 32.

Figure 11:
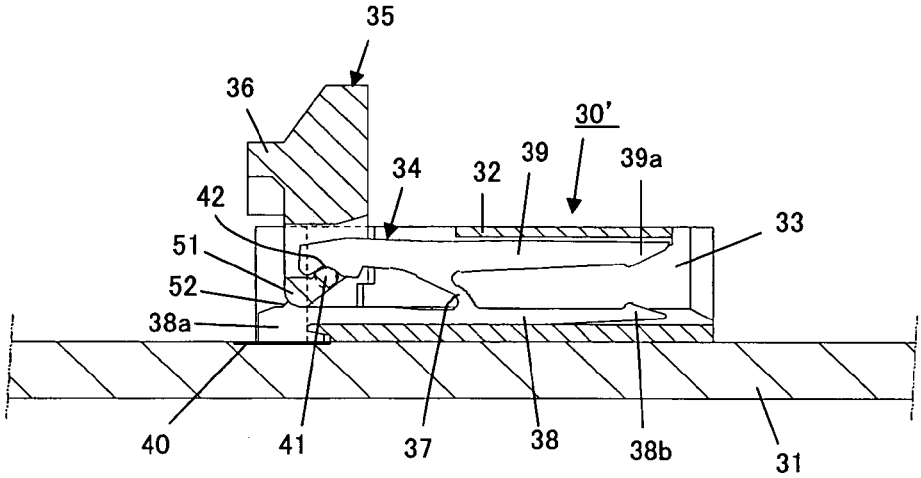
FIGS. 11 and 13 are schematic cross sectional views each used for explaining the structure and operation of the second embodiment shown in FIG. 10.
Figure 12:
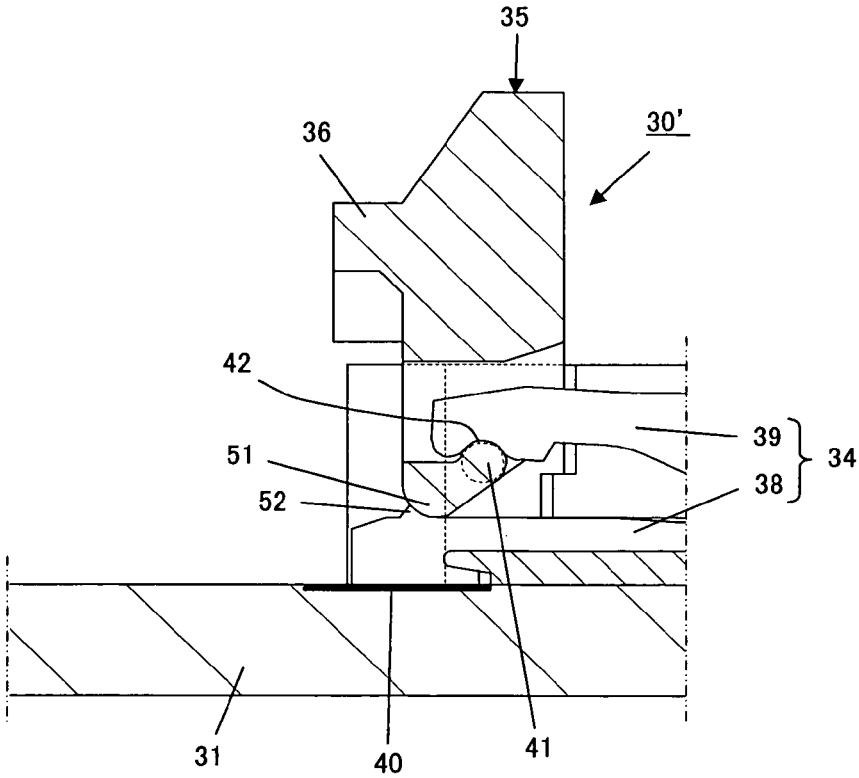
FIG. 12 is a schematic fragmentary enlarged cross sectional view showing a part of FIG. 11.
Figure 13:
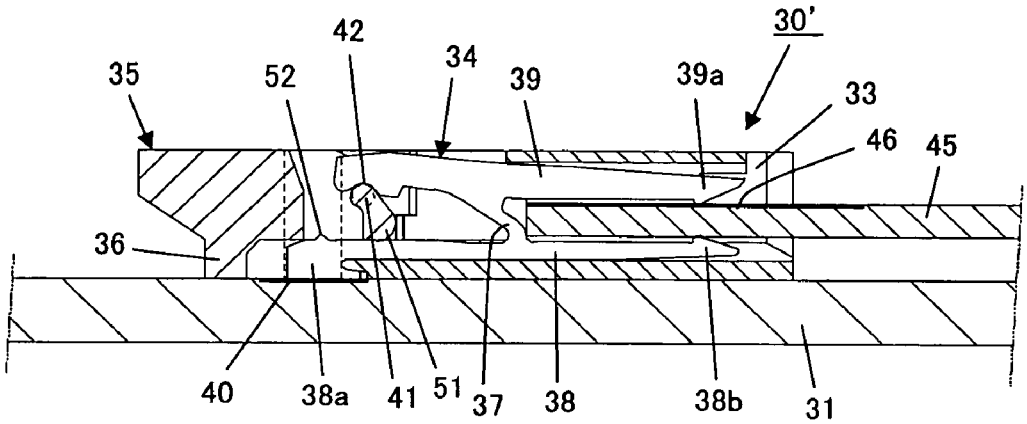
Figure 14:
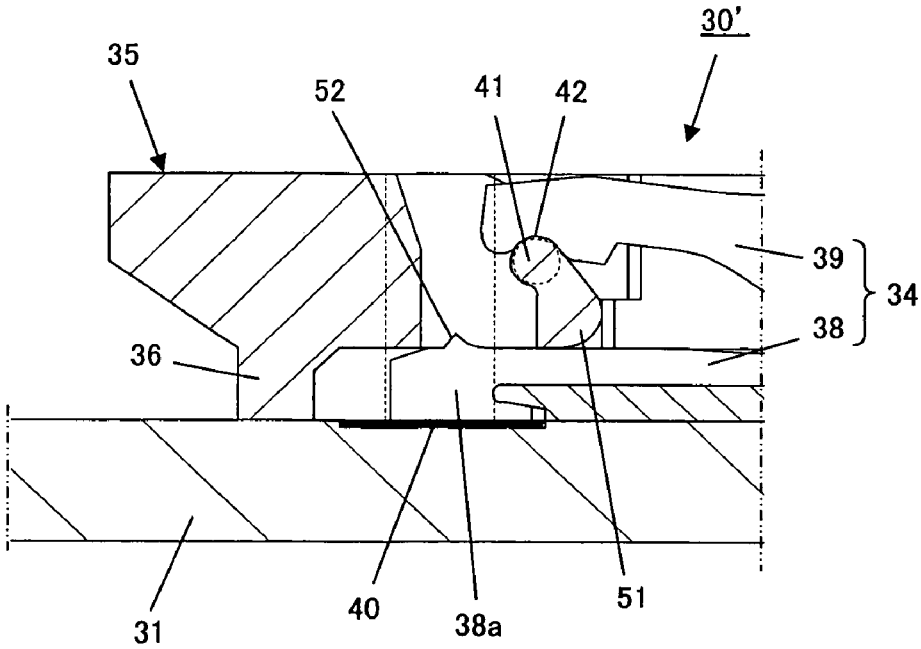
FIG. 14 is a schematic fragmentary enlarged cross sectional view showing a part of FIG. 13.

Further, in the electrical connector 30' shown in FIG. 10, a pointed projection 52 is formed on the beam 38 of each of the conductive contacts 34 for engaging with a moving end portion 51 of the actuator 35, as shown in FIG. 11 showing the electrical connector 30' in which the actuator 35 with the covering portion 36 is in a first station corresponding to the first station in the first embodiment to keep rising from the housing 32 and in FIG. 12 showing a part of FIG. 11 in enlarged scale. The pointed projection 52 does not engage with the moving end portion 51 of the actuator 35 when the actuator 35 is postured to take up the second station to keep lying down on the housing 32, as shown in FIG. 13 showing the electrical connector 30' in which the part of the flexible printed circuit board 45 on which the connecting terminals 46 are arranged is inserted into the housing 32 through the opening 33 provided thereon and the actuator 35 is in the second station to keep laying down on the housing 32 and in FIG. 14 showing a part of FIG. 13 in enlarged scale, but engages with the moving end portion 51 of the actuator 35 when the actuator 35 is postured to take up the first station to rising from the housing 32. With the engagement with the moving end portion 51 of the actuator 35, the pointed projection 52 formed on the beam 38 of each of the conductive contacts 34 is operative to lock the actuator 35 for preventing the same from coming off from the conductive contacts 34.

Figure 15:
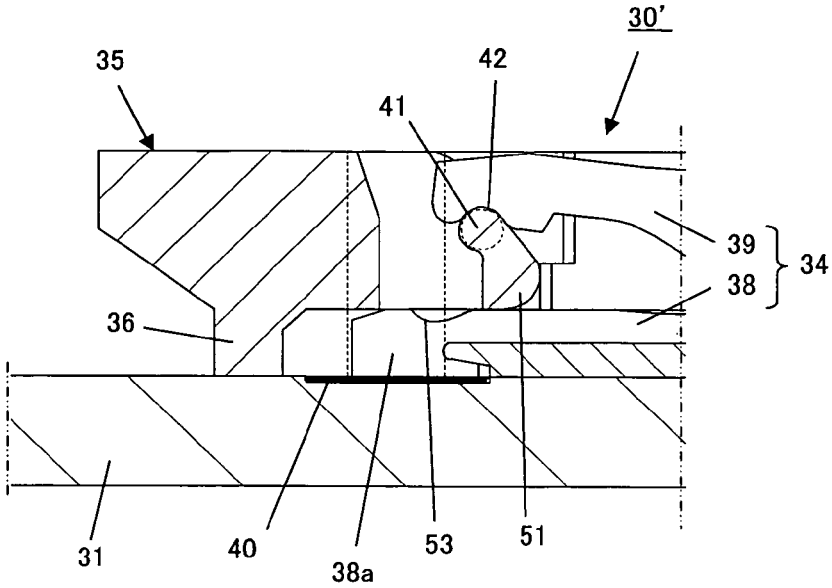
FIGS. 15 and 16 are schematic cross sectional views each used for explaining the structure and operation of a modification of the second embodiment shown in FIG. 10.
Figure 16:
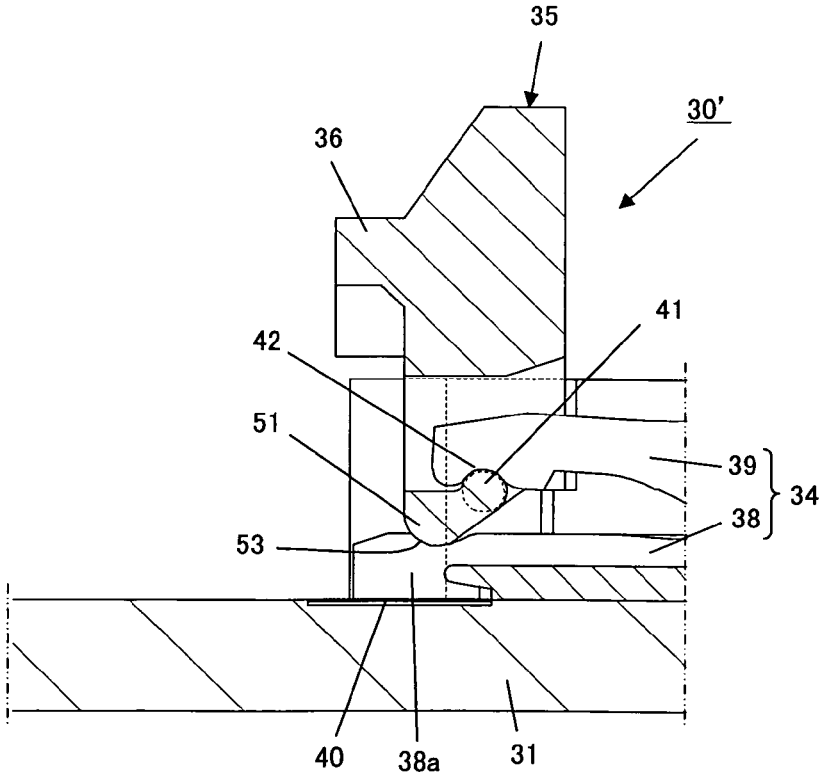

Each of the conductive contacts 34 in the electrical connector 30' shown in FIG. 10 may be provided with an engaging dent 53 in place of the pointed projection 52 shown in FIGS. 11 and 14, as shown in FIGS. 15 and 16. In the case of the electrical connector 30' having the conductive contacts 34 each provided with the engaging dent 53, the engaging dent 53 does not engage with the moving end portion 51 of the actuator 35 when the actuator 35 is postured to take up the second station to keep lying down on the housing 32, as shown in FIG. 15 showing the electrical connector 30' in which the actuator 35 with the covering portion 36 is in the second station to keep laying down on the housing 32, but engages with the moving end portion 51 of the actuator 35 when the actuator 35 is postured to take up the first station to rising from the housing 32, as shown in FIG. 16 showing the electrical connector 30' in which the actuator 35 with the covering portion 36 is in the first station to keep rising from the housing 32.

With the engagement with the moving end portion 51 of the actuator 35, the engaging dent 53 formed on the beam 38 of each of the conductive contacts 34 is operative to lock the actuator 35 for preventing the same from coming off from the conductive contacts 34.

Other portions of the electrical connector 30' shown in FIGS. 10 to 16 are constituted almost in the same manner as the electrical connector 30 shown in FIGS. 4 to 9 and effect and advantages obtained with the electrical connector 30' shown in FIGS. 10 to 16 are substantially the same as those obtained with the electrical connector 30 shown in FIGS. 4 to 9.

What is claimed is:

1. An electrical connector comprising:

a housing made of insulator and attached to a main circuit board, a plurality of conductive contacts arranged in the housing, each of said conductive contacts being positioned to correspond to one of a plurality of connecting terminals provided on a circuit board member when the circuit board member is partially inserted into the housing, and an actuator provided rotatably on the housing to engage with the conductive contacts and to take up first and second stations selectively for bringing each of the conductive contacts into press-contact with one of the connecting terminals corresponding thereto when the circuit board member is partially inserted into the housing and the actuator is shifted from the first station to the second station and for causing each of the conductive contacts to get out of press-contact with the corresponding one of the connecting terminals when the circuit board member partially inserted into the housing and the actuator is shifted from the second station to the first station, wherein said actuator is configured to have a covering portion constituting a bent partition wall and operative to dispose the bent partition wall on the main circuit board so that end portions of the conductive contacts connected electrically with conductive circuit pattern portions provided on the main circuit board are surrounded on three sides by the bent partition wall to be covered and concealed with the covering portion when the actuator is postured to take up the second station.

2. An electrical connector according to claim 1, wherein said covering portion of the actuator is operative to cover and conceal also the conductive circuit pattern portions provided on the main circuit board, with which the end portions of the conductive contacts are connected electrically, when the actuator is postured to take up the second station.

3. An electrical connector according to claim 1, wherein said covering portion of the actuator is operative to cause the bent partition wall to come close to the main circuit board at a position out of the conductive circuit pattern portions on the main circuit board when the actuator is postured to take up the second station.

4. An electrical connector according to claim 1, wherein said actuator is provided with engaging projections and said housing is provided with stoppers positioned to correspond to the engaging projections, respectively, said engaging projections being operative to engage with the stoppers for preventing the actuator from coming off from the housing.

5. An electrical connector according to claim 1, wherein said actuator is positioned at a side of the housing opposite to another side of the housing on which an opening through which the circuit board member is partially inserted into the housing is provided.

6. An electrical connector according to claim 1, wherein said actuator has a plurality of cams each engaging with a movable portion of each of the conductive contacts and operative to move the movable portion to come into press-contact with the connecting terminal provided on the circuit board member which is partially inserted into the housing, and with the operation of said cams, the actuator operates to bring each of the conductive contacts into press-contact with the corresponding connecting terminal.

7. An electrical connector according to claim 6, wherein each of said cams is supported with an engaging portion formed on each of the conductive contacts.

8. An electrical connector according to claim 7, wherein a pointed projection is provided on each of the conductive contacts for locking the actuator for preventing the same from coming off from the conductive contacts.

9. An electrical connector according to claim 7, wherein an engaging dent is provided on each of the conductive contacts for looking the actuator for preventing the same from coming off from the conductive contacts.

* * * * *